US009545934B2

(12) United States Patent
Liu et al.

(10) Patent No.: US 9,545,934 B2
(45) Date of Patent: Jan. 17, 2017

(54) BALANCING APPARATUS FOR A TRANSITION COUPLER

(71) Applicant: CRRC QINGDAO SIFANG ROLLING STOCK RESEARCH INSTITUTE CO., LTD., Shandong (CN)

(72) Inventors: Hui Liu, Shandong (CN); Shuhua Duan, Shandong (CN); Shi Liu, Shandong (CN)

(73) Assignee: CRRC QINGDAO SIFANG ROLLING STOCK RESEARCH INSTITUTE CO., LTD., Shandong (CN)

( * ) Notice: Subject to any disclaimer, the term of this patent is extended or adjusted under 35 U.S.C. 154(b) by 0 days.

(21) Appl. No.: 14/991,897

(22) Filed: Jan. 8, 2016

(65) Prior Publication Data

US 2016/0121911 A1 May 5, 2016

Related U.S. Application Data

(63) Continuation of application No. PCT/CN2014/079473, filed on Jun. 9, 2014.

(30) Foreign Application Priority Data

Nov. 20, 2013 (CN) ..... 2013 1 0587347
Nov. 20, 2013 (CN) ..... 2013 2 0736526 U

(51) Int. Cl.
*B61G 5/04* (2006.01)
*B61G 7/00* (2006.01)

(52) U.S. Cl.
CPC .. *B61G 5/04* (2013.01); *B61G 7/00* (2013.01)

(58) Field of Classification Search
CPC ..... B61G 5/04; B61G 5/00; B61G 7/00; B61G 7/06; B61G 7/08; B61G 7/12; B61G 7/14
(Continued)

(56) References Cited

U.S. PATENT DOCUMENTS 1,605,414 A * 11/1926 Willison ..... B61G 5/04 213/112
1,647,486 A 11/1927 Trimming
(Continued)

FOREIGN PATENT DOCUMENTS

CN 102009664 A 4/2011
CN 103569150 A 2/2014
(Continued)

OTHER PUBLICATIONS

Wu, Gang et al., "The research of the transition coupler of the $CRH_2EMU$" Locomotive & Rolling Stock Technology, vol. 3, Jun. 2012, pp. 26 and 27.
(Continued)

*Primary Examiner* — Mark Le
(74) *Attorney, Agent, or Firm* — J.C. Patents

(57) ABSTRACT

A balancing apparatus comprises a rotating shaft (2) arranged on a transition coupler (1), a rotating rod (4) and a top seat (7). The rotating rod (4) comprises an upper and lower end plates (11,12), and a ramp protrusion (13) that is arranged between the upper and lower end plates (12), and is of a sheet protruding structure; when the upper and lower end plates serve as the reference, in the longitudinal direction, the ramp protrusion (13) outward inclines towards the rotating rod, one end of the rotating rod (4) is arranged on the rotating shaft, a pin shaft (5) is arranged at the other end of the rotating rod (4), an eyelet bolt (6) is further arranged on the pin shaft (5), and the rotating rod (4) can rotate around
(Continued)

the rotating shaft (2) and hinged to the eyelet bolt (6) through the pin shaft (5). A through hole is formed in the top seat (7), the eyelet bolt (6) penetrates through the through hole in the top seat, a nut (9) is fixedly arranged at the tail end of the eyelet bolt (6), a spring (10) is arranged between the nut (9) and the through hole of the top seat (7), and the diameter of the spring (10) is larger than the diameter of the through hole in the top seat (7). The balancing apparatus prevents a "bent head" phenomenon in a transition coupler when coupling car-couplers.

7 Claims, 3 Drawing Sheets

(58) Field of Classification Search
USPC ..... 213/112, 75 R, 19, 20, 183, 18, 100 R, 213/104, 109, 111
See application file for complete search history.

(56) References Cited

U.S. PATENT DOCUMENTS 3,145,852 A * 8/1964 Kulieke ..... B61G 5/04 213/112
8,596,475 B2 * 12/2013 Kobert ..... B61G 5/04 213/178

FOREIGN PATENT DOCUMENTS

| | | | | |
|---|---|---|---|---|
| CN | 203558079 | U | | 4/2014 |
| DE | 1044137 | | * | 11/1958 |
| DE | 1052437 | | * | 3/1959 |
| DE | 3838624 | A1 | | 9/1989 |
| FR | 1203240 | | * | 1/1960 |
| GB | 411493 | | * | 6/1934 |
| GB | 987087 | | * | 3/1965 |
| GB | 989261 | | * | 4/1965 |
| GB | 2 257 953 | B | | 2/1995 |
| JP | Y40-5362 | | | 2/1965 |
| JP | H10-273044 | A | | 10/1998 |
| JP | 2011-1056 | A | | 1/2011 |
| RU | 92 638 | U1 | | 3/2010 |

OTHER PUBLICATIONS

International Search Report of corresponding International PCT Application No. PCT/CN2014/079473, dated Jun. 9, 2014.
Chinese First Examination Report of corresponding China Application No. 201310587347.6, dated Sep. 17, 2014.

* cited by examiner

BALANCING APPARATUS FOR A TRANSITION COUPLER

CROSS-REFERENCE TO RELATED APPLICATION

This application is a continuation application of, and claims the priority benefit of International Application No. PCT/CN2014/079473, filed on Jun. 09, 2014, which in turn claims the priority benefits of China patent application No. 201310587347.6, filed on Nov. 20, 2013, and China patent application No. 201320736526.7, filed on Nov. 20, 2013. The contents of these prior applications are hereby incorporated by reference in their entirety.

FIELD OF THE INVENTION

The invention relates to a balancing apparatus for a transition coupler, in particular to a balancing apparatus for a transition coupler whose No. 15/13 coupler is an adaptive and tight-lock coupler.

BACKGROUND OF THE INVENTION

A transition coupler is an important device used for shunting operation, train delivery and rescue. In the field of railway vehicles, it is very common of application of the transition coupler whose No. 15/13 coupler is an adaptive and tight-lock coupler.

The existing transition coupler is not provided with a balancing apparatus. In the process of field application, as the coupling gap of the No. 15/13 coupler is large, the tight-lock coupler end of the transition coupler after installation may be lowered under its own weight so that the tight-lock coupler end is difficult of coupling with a formal coupler unless the coupling speed is increased. Under this circumstance, not only the tight-lock coupler is easily damaged, but also the vehicle body may be subject to negative influence.

In the shunting operation site, some shunters put wood chips or metal plates under the No. 15/13 coupler, which can relieve the "bent head" phenomenon. However, this method is difficult for operation, and unable to solve problems fundamentally.

SUMMARY OF THE INVENTION

The present invention aims at providing a balancing apparatus for a transition coupler, which is mainly used in the No. 15/13 coupler and can effectively prevent the transition coupler from "bent head".

The technical solution of the invention is: a balancing apparatus for a transition coupler, wherein the said balancing apparatus for a transition coupler is arranged on the upper end face of the transition coupler; the balancing apparatus for a transition coupler comprises a rotating shaft arranged on the transition coupler, a rotating rod and a top seat; the rotating rod comprises an upper end plate and a lower end plate, a ramp protrusion is arranged between the upper end plate and the lower end plate, the ramp protrusion is located on the side face of the lower end plate, the ramp protrusion is of a sheet protruding structure; when the upper end plate and the lower end plate of the rotating rod serve as the reference, in the longitudinal direction, the ramp protrusion is of the structure that the ramp protrusion outward inclines towards the rotating rod, one end of the rotating rod is arranged on the rotating shaft, a pin shaft is arranged at the other end of the rotating rod, an eyelet bolt is further arranged on the pin shaft, and the rotating rod can rotate around the rotating shaft and hinged to the eyelet bolt through the pin shaft; a through hole is formed in the top seat, the eyelet bolt penetrates through the through hole in the top seat, a nut is fixedly arranged at the tail end of the eyelet bolt, a spring is arranged between the nut and the through hole in the top seat, and the diameter of the spring is larger than the diameter of the through hole in the top seat.

Preferentially, the rotating rod is provided with a rotating shaft connection hole and is connected to the rotating shaft via the rotating shaft connection hole; the rotating rod is also provided with pin shaft connection holes and is connected to the pin shaft via the pin shaft connection holes; there are a plurality of pin shaft connection holes in longitudinal arrangement along the length direction of the rotating rod.

Preferentially, the position of the ramp protrusion along the horizontal direction is between the horizontal position of the rotating shaft connection hole and the horizontal position of the pin shaft connection hole.

Preferentially, the position of the rotating shaft connection hole along the horizontal direction is between the horizontal position of the ramp protrusion and the horizontal position of the pin shaft connection hole.

Preferentially, the said through hole is a long hole.

Preferentially, the said through hole is provided with a counter bore.

Preferentially, multiple-group pin holes are arranged at the tail end of the eyelet bolt where the nut is arranged, cotter pins are penetrated into the pin holes, the nut is arranged at the front end of the cotter pins and is fixed by the cotter pins.

The advantageous effects of the present invention are as below:

(1) The balancing apparatus for a transition coupler in the present invention is arranged on the contact surface S where the transition coupler is coupled with the No. 15/13 coupler, the ramp protrusion on the balancing apparatus is in contact with No. 15/13 coupler, the force produced downward by "bent head" of the transition coupler during coupling is applied to the No. 15/13 coupler by the ramp protrusion on the balancing apparatus for a transition coupler, which can effectively prevent the coupler from "bent head" during coupling and ensure the transition coupler horizontal after installation.

(2) Under the tension state of the coupler, the balancing apparatus is stretched; as the spring is further compressed, the rotating rod rotates anticlockwise around the rotating shaft, and the size of the lug boss beyond Surface S is reduced until all the rotating rod profile is beyond Surface S so as to prevent the balancing apparatus from being stressed under the tension state; so the balancing apparatus has long service life.

(3) In the balancing apparatus, the pre-tightening force of the spring is adjusted by adjusting the nut position and the position of the eyelet bolt installed on the pin shaft connection hole; the balancing apparatus is still applicable when the No. 15/13 coupler is changed in terms of specific model.

(4) The relative horizontal positions of the rotating shaft hole on the rotating rod, the pin shaft hole and the ramp protrusion can be set flexibly, applicable to different coupler structures.

(5) The through hole on the top seat is a long hole, adaptive to requirements for motion curve in the moving process of the eyelet bolt; a counter bore is arranged at the through hole for fixing the eyelet bolt so that the eyelet bolt can move relatively stably.

DETAILED DESCRIPTION OF THE EMBODIMENTS

Figure 1:
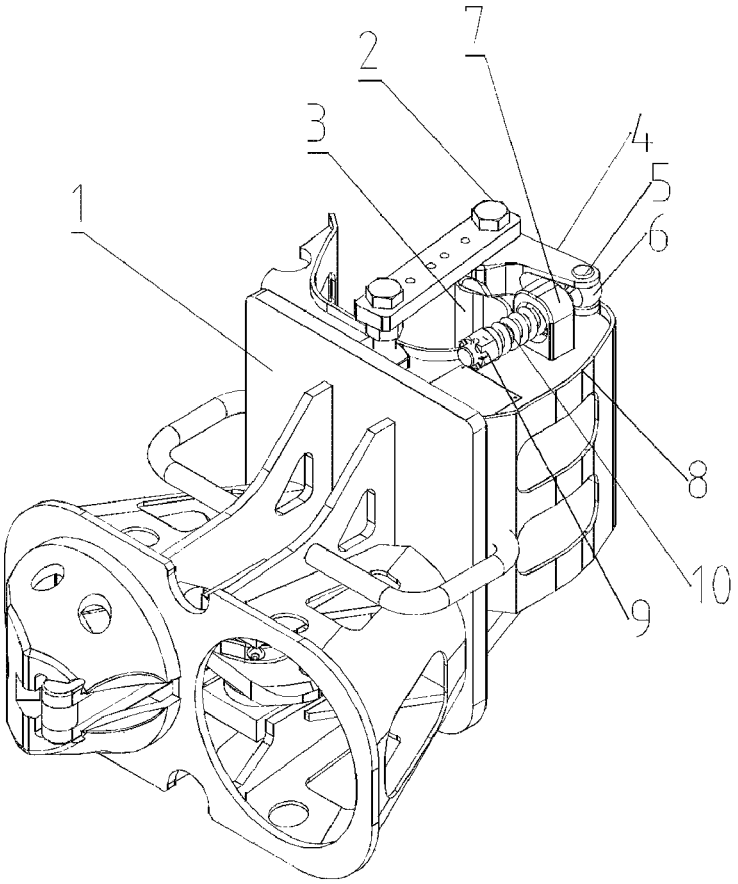
FIG. 1 is a structure diagram for installation of the transition coupler of the invention.
Figure 2:
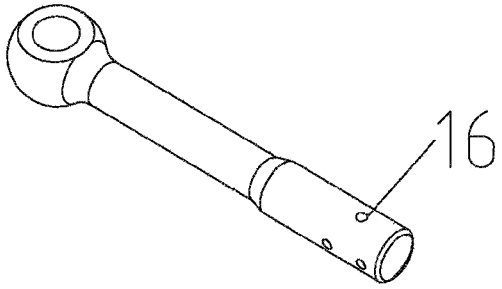
FIG. 2 is a structure diagram of the eyelet bolt of the invention.
Figure 3:
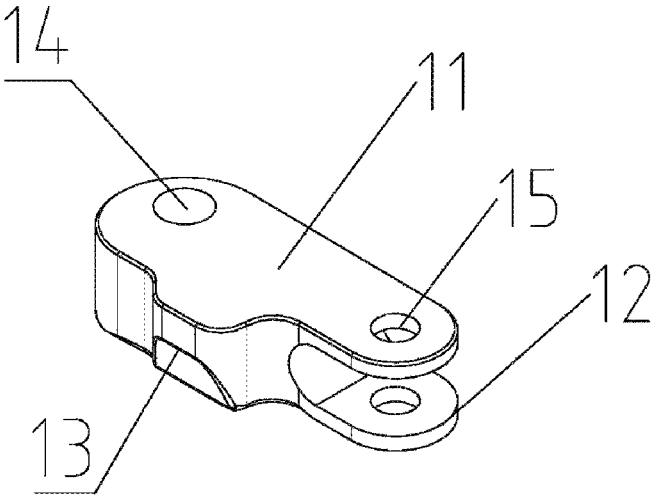
FIG. 3 is a structure diagram of the rotating rod in Embodiment 1 of the invention.
Figure 4:
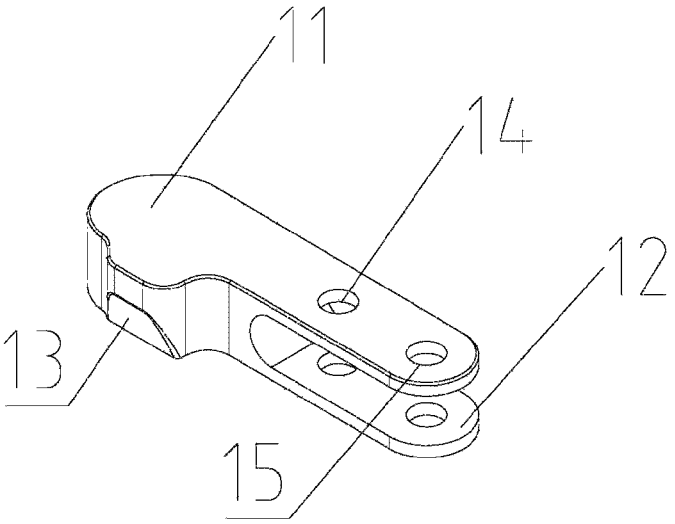
FIG. 4 is a structure diagram of the rotating rod in Embodiment 2 of the invention.

Further description of embodiments in the invention is made in combination with the accompanying drawings.

Embodiment 1

As shown in FIGS. 1-4, the balancing apparatus for a transition coupler is arranged on the upper end face of the transition coupler 1. The balancing apparatus for a transition coupler comprises a rotating shaft 2 arranged on the transition coupler 1, a rotating rod 4 and a top seat 7; The rotating rod 4 comprises an upper end plate 11 and a lower end plate 12, a ramp protrusion 13 is arranged on the lower end plate 12, the ramp protrusion 13 is located on the side face of the lower end plate, the ramp protrusion 13 is of a sheet protruding structure; when the upper end plate 11 and the lower end plate 12 of the rotating rod 4 serve as the reference, in the longitudinal direction, the ramp protrusion 13 is of the structure that the ramp protrusion outward inclines towards the rotating rod 4, one end of the rotating rod 4 is arranged on the rotating shaft 2, a pin shaft 5 is arranged at the other end of the rotating rod 4, an eyelet bolt 6 is further arranged on the pin shaft 5, and the rotating rod 4 can rotate around the rotating shaft 2 and hinged to the eyelet bolt 6 through the pin shaft 5. A through hole is formed in the top seat 7, the eyelet bolt 6 penetrates through the through hole in the top seat 7, the through hole is a long hole, and the through hole is provided with a counter bore; the long hole can meet requirements for the motion range in the moving process of the eyelet bolt 6; the counter bore can fix the eyelet bolt 6. A nut 9 is arranged at the tail end of the eyelet bolt 6, a spring 10 is arranged between the nut 9 and the through hole in the top seat 7, and the diameter of the spring 10 is larger than the diameter of the through hole in the top seat 7.

The rotating rod 4 is provided with a rotating shaft connection hole 14 and is connected to the rotating shaft 2 via the rotating shaft connection hole 14; the rotating rod 4 is also provided with pin shaft connection holes 15 and is connected to the pin shaft 5 via the pin shaft connection holes 15; there are plurality of pin shaft connection holes 15, and the plurality of pin shaft connection holes 15 in longitudinal arrangement along the length direction of the rotating rod 4. The position of the ramp protrusion 13 along the horizontal direction is between the horizontal position of the rotating shaft connection hole 14 and the horizontal position of the pin shaft connection hole 15. This structure is particularly applicable to the transition coupler whose No. 15/13 coupler is an adaptive and tight-lock coupler because this transition coupler is provided with a mounting hole adaptive to the position of the rotating shaft connection hole 14.

Multiple-group pin holes 16 are arranged at the tail end of the eyelet bolt where the nut is arranged, cotter pins are penetrated into the pin holes 16, and the pin holes 16 is in longitudinal arrangement on a stud shaft of the eyelet bolt 6, the nut 9 is arranged at the front end of the cotter pins and is fixed by the cotter pins.

Figure 5:
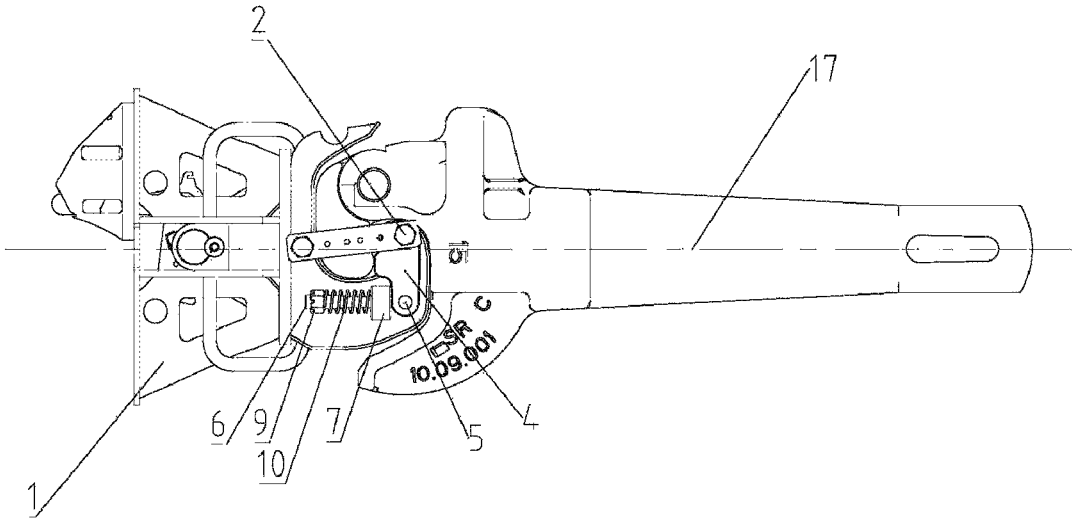
FIG. 5 is a structure diagram of the working principle of the invention.

FIG. 5 is a vertical view of the invention in operation. When in working, the balancing apparatus for a transition coupler is arranged on the horizontal end face of the transition coupler, the ramp protrusion 13 is close to the side of Surface S of the coupler knuckle of the coupler; the ramp protrusion 13 is of the inclined sheet structure, and the longitudinal dimension thereof under installation state is beyond the joint face between the coupler knuckle and Surface S of the No. 15/13 coupler head.

Under working state, the No. 15/13 coupler is fixed to the locomotive, and is connected to the transition coupler 1. In the coupling process, the transition coupler 1 is prone to "bent head" as the transition coupler 1 is heavier than the No. 15/13 coupler. In the "bent head" process of the transition coupler 1, the ramp protrusion 13 contacts with the Surface S of the No. 15/13 coupler knuckle as the rotating rod 2 is higher than the Surface S in terms of longitudinal dimension, thus playing a guiding role in coupling. After the transition coupler 1 is coupled to the No. 15/13 coupler, downward force exerted by the ramp protrusion 13 is applied to the Surface S of the No. 15/13 coupler knuckle, thus the gap between the transition coupler 1 and the upper side of Surface S of the No. 15/13 coupler is shortened, i.e. the tight-lock coupler end is forced to raise up by uncoupling; so the self-weight effect of transition coupler 1 and the effect of force exerted by the ramp protrusion 13 are canceled out, thus ensuring the transition coupler 1 installed at a horizontal status.

Under tension load of the transition coupler 1, the Surface S of the No. 15/13 coupler is applied to the ramp protrusion 13 of the rotating rod 4 so that the rotating rod 4 has a trend to contrarotation relative to the rotating shaft 2; as the inner hole of the top seat 7 is a long hole, the rotating rod 4 can drive the eyelet bolt 6 to move, in this process, the spring 10 is compressed, at the same time, the rotating rod 4 continues rotating around the rotating shaft 2 until all the rotating rod 4 profile is beyond Surface S where the transition coupler 1 contacts with the 15/13 coupler knuckle so as to prevent the balancing apparatus from being directly stressed under the tension state, thus ensuring the rotating shaft 2 is stressed lightly and the spring 10 compressed length is within a certain value, preventing the service life thereof is shortened due to fatigue.

In the use process, pre-tightening force of the spring 10 may be adjusted as the spring 10 is aging or the specific model of the 15/13 coupler is changed, under this circumstance, the position of the cotter pin installed on the eyelet bolt 6 is adjusted and the cotter pin is installed in different pin holes 16, in this way, the pre-tightening force of the spring 10 can be adjusted by adjusting the nut position.

The number of the pin shaft connection holes 15 on the rotating rod 4 is more than one; in the use process, pre-tightening force of the spring 10 may be adjusted as the spring 10 is aging or the specific model of the 15/13 coupler is changed, under this circumstance, the installation position of the eyelet bolt 6 is adjusted by adjusting the position of the pin shaft 5 installed on different pin shaft connection holes 15, thus achieving the objective of adjusting the pre-tightening force of the spring 10.

After use, the tight-lock coupler end is uncoupled, then the transition coupler 1 is separated from the No. 15/13 coupler, the spring 10 is returned to the original length under the action of restoring force, thus driving the eyelet bolt 6 and further driving the rotating rod 4 to rotate until the rotating rod 4 is returned to its original position, and the whole balancing apparatus is completely returned to its original state without any manual intervention.

Embodiment 2

As couplers of different models have different specific shapes, then different from Embodiment 1, the structure of the rotating rod is further improved; the position of the rotating shaft connection hole 14 along the horizontal direction is between the horizontal position of the ramp protrusion 13 and the horizontal position of the pin shaft connection hole 15. This design is applicable to other types of transition couplers, and the position of the rotating shaft connection hole 14 can be designed according to specific shapes of couplers.

What is claimed is:

1. A balancing apparatus for a transition coupler, wherein the balancing apparatus for a transition coupler is arranged on an upper end face of the transition coupler; the balancing apparatus for a transition coupler comprises a rotating shaft arranged on the transition coupler, a rotating rod and a top seat; the rotating rod comprises an upper end plate and a lower end plate, a ramp protrusion is arranged between the upper end plate and the lower end plate, the ramp protrusion is located on a side face of the lower end plate, the ramp protrusion is of a sheet protruding structure; when the upper end plate and the lower end plate of the rotating rod serve as a reference, in a longitudinal direction, the ramp protrusion is of a structure that the ramp protrusion outward inclines towards the rotating rod, one end of the rotating rod is arranged on the rotating shaft, a pin shaft is arranged at the other end of the rotating rod, an eyelet bolt is further arranged on the pin shaft, and the rotating rod can rotate around the rotating shaft and hinged to the eyelet bolt through the pin shaft; a through hole is formed in the top seat, the eyelet bolt penetrates through the through hole in the top seat, a nut is fixedly arranged at a tail end of the eyelet bolt, a spring is arranged between the nut and the through hole in the top seat, and a diameter of the spring is larger than a diameter of the through hole in the top seat.

2. The balancing apparatus for a transition coupler according to claim 1, wherein the rotation rod is provided with a rotating shaft connection hole and is connected to the rotating shaft via the rotating shaft connection hole; the rotating rod is also provided with pin shaft connection hole and is connected to the pin shaft via the pin shaft connection holes; there are a plurality of pin shaft connection holes in longitudinal arrangement along the length direction of the rotating rod.

3. The balancing apparatus for a transition coupler according to claim 2, wherein the position of the ramp protrusion (13) along a horizontal direction is between a horizontal position of a rotating shaft connection hole and a horizontal position of a pin shaft connection hole.

4. The balancing apparatus for a transition coupler according to claim 2, wherein a position of a rotating shaft connection hole along a horizontal direction is between a horizontal position of the ramp protrusion (13) and a horizontal position of a pin shaft connection hole.

5. The balancing apparatus for a transition coupler according to claim 1, wherein the through hole is a long hole.

6. The balancing apparatus for a transition coupler according to claim 5, wherein the through hole is provided with a counter bore.

7. The balancing apparatus for a transition coupler according to claim 1, wherein multiple-group pin holes are arranged at the tail end of the eyelet bolt where the nut is arranged, cotter pins are penetrated into the pin holes, the nut is arranged at a front end of the cotter pins and is fixed by the cotter pins.

* * * * *